US007272335B2

(12) United States Patent
Horiuchi

(10) Patent No.: US 7,272,335 B2
(45) Date of Patent: Sep. 18, 2007

(54) IMAGE FORMING DEVICE

(75) Inventor: Nobuhiro Horiuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/275,631

(22) Filed: Jan. 19, 2006

(65) Prior Publication Data

US 2006/0159481 A1 Jul. 20, 2006

(30) Foreign Application Priority Data

Jan. 20, 2005 (JP) ..... 2005-013269

(51) Int. Cl.
*G03G 15/00* (2006.01)

(52) U.S. Cl. ..... 399/88; 399/392; 399/393

(58) Field of Classification Search ..... 399/88, 399/392, 393
See application file for complete search history.

(56) References Cited

U.S. PATENT DOCUMENTS 3,649,114 A * 3/1972 Vlach et al. ..... 399/78
5,008,715 A * 4/1991 Imaizumi et al. ..... 399/392

FOREIGN PATENT DOCUMENTS

JP 2003/233276 A 8/2003

* cited by examiner

*Primary Examiner*—David M. Gray
*Assistant Examiner*—Erika J. Villaluna
(74) *Attorney, Agent, or Firm*—Global IP Conselors, LLP

(57) ABSTRACT

An image forming device is disclosed which includes an open/close switch for detecting the opening and closing of a manual feed tray, and a power control unit for turning on specific power when the open/close switch detects that the manual feed tray has been opened. When the manual feed tray is opened, the use is assumed to be about to use the image forming device, and thus energy conservation becomes possible because the specific power is turned on only at this time. Moreover, the drive power for the bypass unit and the main power of the image forming device is defined to be this specific power.

14 Claims, 5 Drawing Sheets

IMAGE FORMING DEVICE

BACKGROUND OF THE INVENTION

1. Field of the Invention

The present invention relates to an image forming device such as a printer, copying machine, MFP, or the like.

2. Background Information

In recent years, an image forming device such as a printer, copying machine, MFP or the like has been widely used in not only offices, but in homes as well. FIG. 1 is an external view of such image forming device. These types of image forming devices typically include a paper supply cassette 1 and manual feed tray 2 as shown in FIG. 1.

In other words, the paper supply cassette 1 stores paper determined by a user in advance such as A4 size or the like (standard paper), and the paper is supplied to the printing unit from the paper supply cassette 1 when using the paper. The part which performs the supply operation is called the main unit.

Conversely, when printing on paper that differs from standard paper, i.e., special paper such as a post card, OHP film, or the like, a user opens the manual feed tray 2 (indicated by the arrow A) and inserts the special paper into this manual feed tray 2. The part which performs the operation in which paper is supplied from the manual feed tray 2 to the printing unit is called the bypass unit. In addition, when printing is performed without using special paper, the manual feed tray 2 is preferably closed (arrow B) in order to protect the image forming device from dust.

In view of the demand for energy savings, there have been demands in recent years for the development of technology that can conserve power consumption to the maximum extent in this type of image forming device. Such energy saving technology is disclosed in Japanese Laid-Open Patent Publication 2003-233276. This technology switches to power save mode when paper cannot be detected or when a user is not present around an image forming device.

However, there are the following problems with the technology in the aforementioned reference.

First, switching to power save mode when paper cannot be detected because paper has run out during a print job of multiple images is not suitable, as the user is most likely to replenish the paper supply immediately and resume printing. This is especially the case if switching to power save mode when running out of paper while the user is away from the image forming device, as the heating roller of the fusing unit will need to be re-heated to resume printing and this requires additional time.

Further, a plurality of sensors to detect the absence of a user must be provided for switching to power save mode when a user is not present around the image forming device, thereby causing the circuit design to become complicated and expensive.

An object of the present invention, having given consideration to such problems, is to provide an image forming device that reliably detects whether a user is to use the image forming device or not, and has the ability to conserve power consumption with an inexpensive and simple design.

SUMMARY OF THE INVENTION

An image forming device comprises a main unit for supplying paper from the paper supply cassette to the feeding unit, a bypass unit for supplying paper from an openable and closable manual feed tray to the feeding unit, an open/close switch to detect the opening and closing of the manual feed tray, and a first power supply control unit for supplying a specific power when the open/close switch detects that the manual feed tray is open. When the manual feed tray is opened, it is thought to be evident that the user is about to use the image forming device, and thus power saving is ensured by supplying the specific power only at that time.

The drive power of the bypass unit and the main power of the image forming device are assumed as the specific power.

The first power supply control unit is provided in order to cutoff the drive power to the bypass unit when the open/close switch detects that the manual feed tray is closed. Because it is apparent that the user is not about to use the bypass unit when the manual feed tray is closed, power saving will be ensured by cutting off the power to this part. In addition, cutting off of the main power is not preferred as there is a possibility that one will want to perform printing by using the main unit when the manual feed tray is closed.

In addition, the main power supply of the image forming unit may also function as the drive power supply of the main unit. In this situation, a second power supply control unit may be provided which cuts off the drive power of the main unit when the open/close switch detects that the manual feed tray is open. Furthermore, the second power supply control unit may also transmit the drive power of the main unit when the open/close switch detects that the manual tray has been closed.

According to the above, whether or not a user is about to use the image forming device can be reliably detected, and thereby enable energy conservation.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Preferred embodiments of the present invention are explained hereafter with reference to the drawings.

Figure 1:
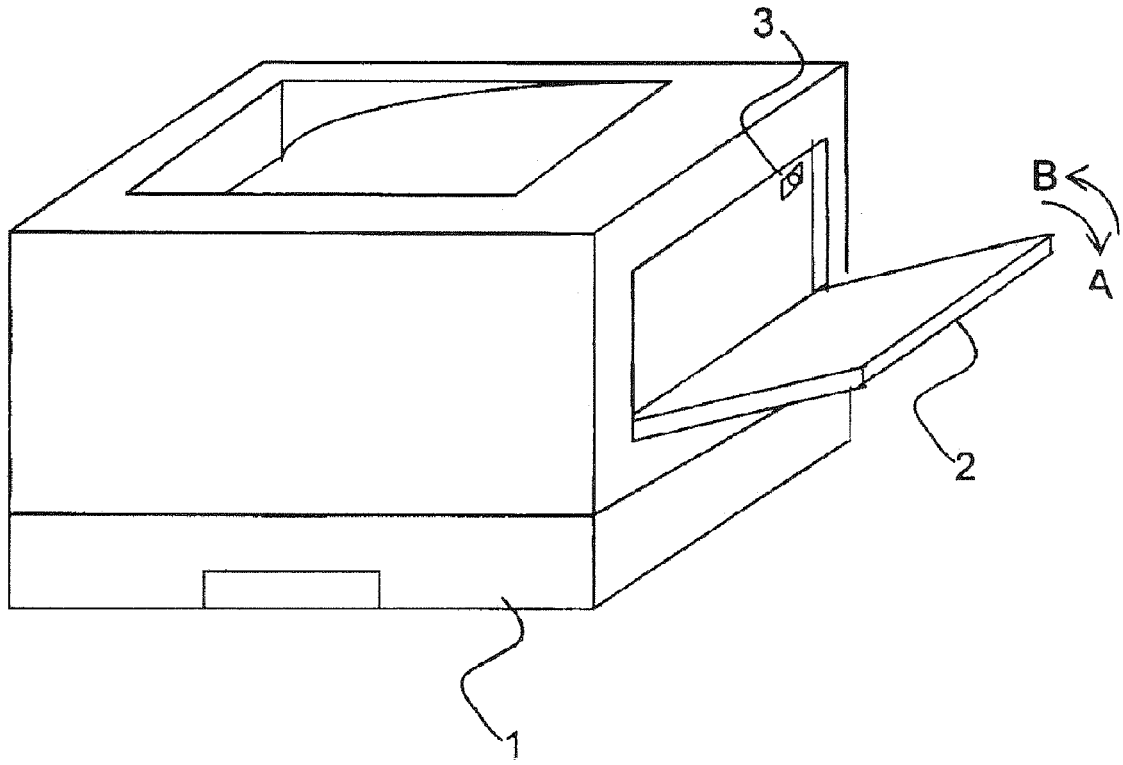
FIG. 1 is an external view of an image forming device according to the present invention.
Figure 2:
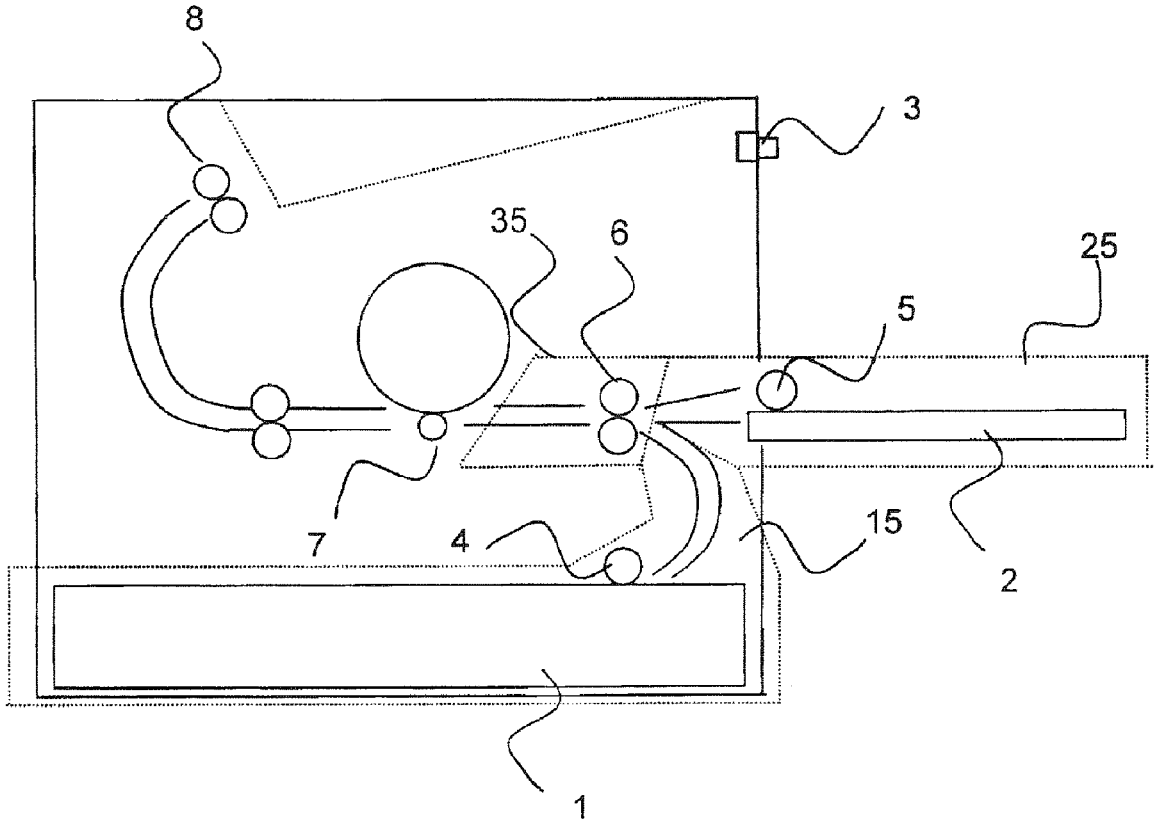
FIG. 2 is a block diagram of the image forming device of the present invention.

An image forming device of the present invention includes a paper supply cassette 1, and a manual feed tray 2, as shown in FIG. 1. The part which supplies paper from the paper supply cassette 1 to the feeding unit 35 as shown FIG. 2 is referred to as the main unit 15. Further, the part which supplies paper from the manual feed tray 2 to the feeding unit 35 is referred to as the bypass unit 25. The feeding unit 35 is a common part for feeding paper supplied from either the main unit 15 or the bypass unit 25 to the image forming unit 7. Electronic components are provided for the main unit 15 and the bypass unit 25 such as a paper set sensor for detecting whether paper is set in each, a paper size detection sensor for detecting the size of the paper, and a paper clutch for controlling the drive of the paper rollers 4, 5 that supply paper (none of which are shown in the drawing).

Further, a push type open/close switch 3 is provided for detecting the opening or closing of the bypass unit 25, and such detection occurs when the open/close switch 3 is pushed by the closing of the manual feed tray.

Figure 3:
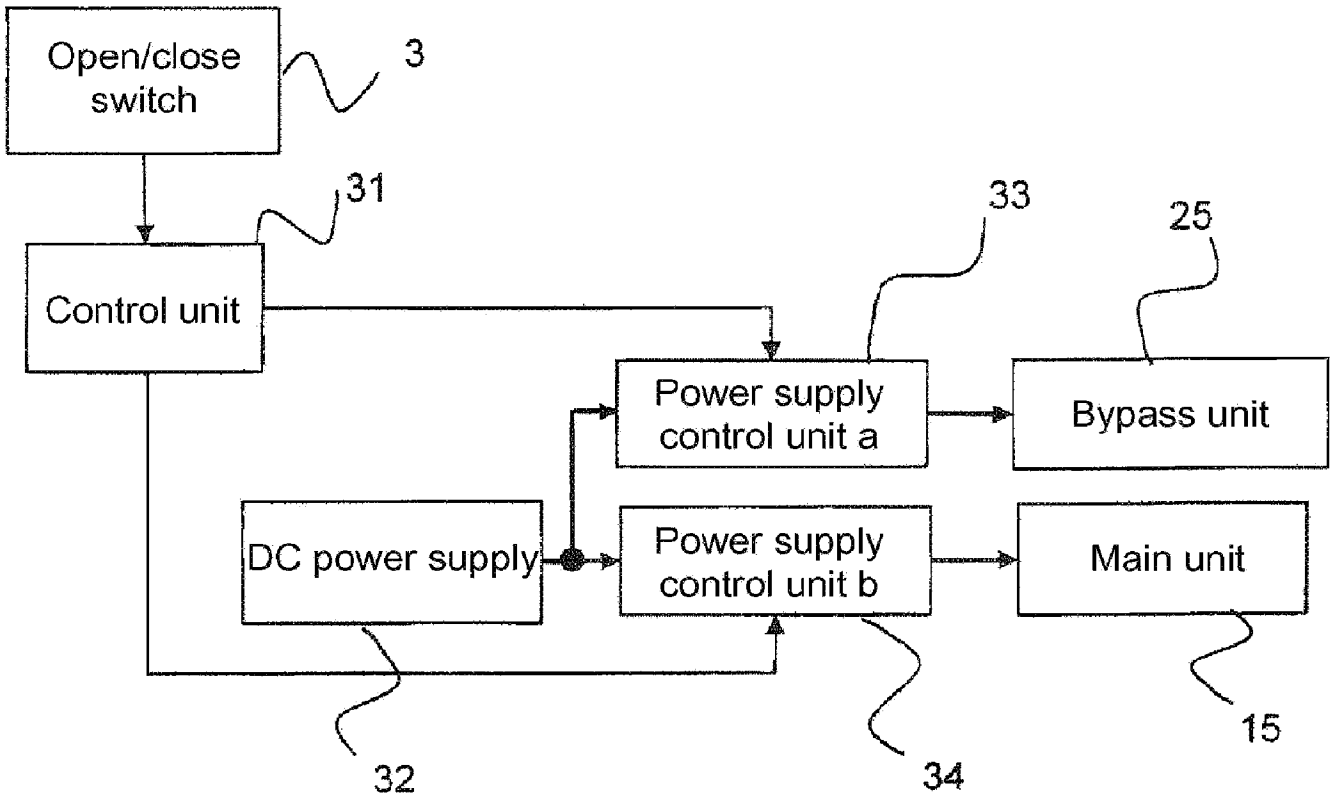
FIG. 3 is a block diagram of an embodiment of the present invention.

FIG. 3 shows a block diagram showing the construction of the present invention. The drive power for the bypass unit 25 is supplied from a DC power supply 32 through a power supply control unit a 33. The drive power for the main unit 15 is supplied from the DC power supply 32 through a power supply control unit b 34. Both of the power supply control units 33 and 34 are constructed with the ability to switch by means of a relay, for example, and are constructed with the ability to turn the drive power ON and OFF by means of a control signal from the control unit 31. The control unit 31 is constructed of a CPU not shown in the drawing, a ROM for storing the control software, and RAM for temporarily saving various data. The control unit 31 controls the power supply control unit a 33 and the power supply control unit b 34 by means of the open and close signals of the open/close switch 3.

With this construction, the control unit 31, through the open/close switch signal, can detect that the manual feed tray 2 has been opened and turn on the power to the power supply control unit a 33 thereby enabling drive power to flow to the bypass unit 25 when a user opens the manual tray 2 (arrow A in FIG. 1). Further, the power to the power supply control unit b 34 may also be turned off at this time, cutting drive power to the main unit 15. Conversely, when a user closes the manual feed tray 2 (arrow B of FIG. 1), the control unit 31, through the open/close switch signal, can detect that the manual feed tray 2 has been closed and turn off the power to the power supply control unit a 33, thereby cutting the drive power to the bypass unit 25. Further, the power to the power supply control unit b 34 may also be turned on at this time, connecting the drive power to the main unit 15.

In other words, when the manual feed tray 2 is closed, the user certainly will not use the bypass unit 25, therefore, energy conservation can be devised by cutting the drive power to the bypass unit 25. Further, the power connectivity to the main unit 15 can also be controlled in this way since opening the manual feed tray 2 indicates that a user intends to use the manual feed tray 2, and so the power to the main unit 15 can be cut. When the manual tray 2 is closed, the user will certainly not use the bypass unit 25, so energy conservation can be achieved by transmitting power to the main unit 15.

Figure 4:
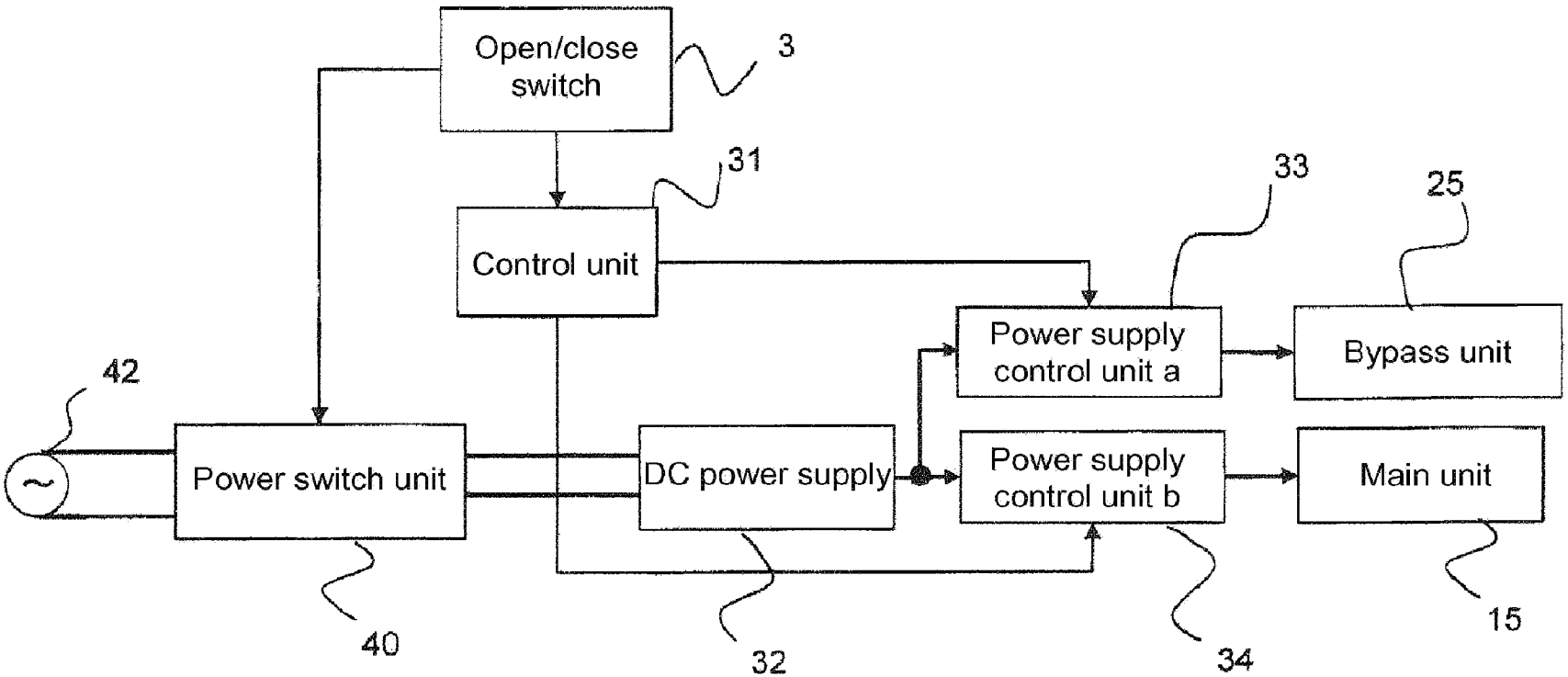
FIG. 4 is a block diagram of a second embodiment of the present invention.

A block diagram showing the construction of a second embodiment is shown in FIG. 4. A power switch 40 for transmitting and cutting off electric power is provided between the DC power supply 32 and the AC power supply, and two polar push switches are arranged as the open/close switch 3, with one pole thereof used to control the on, off of the power switch 40. All other construction is the same as the previous embodiment and a description thereof is omitted.

Figure 5:
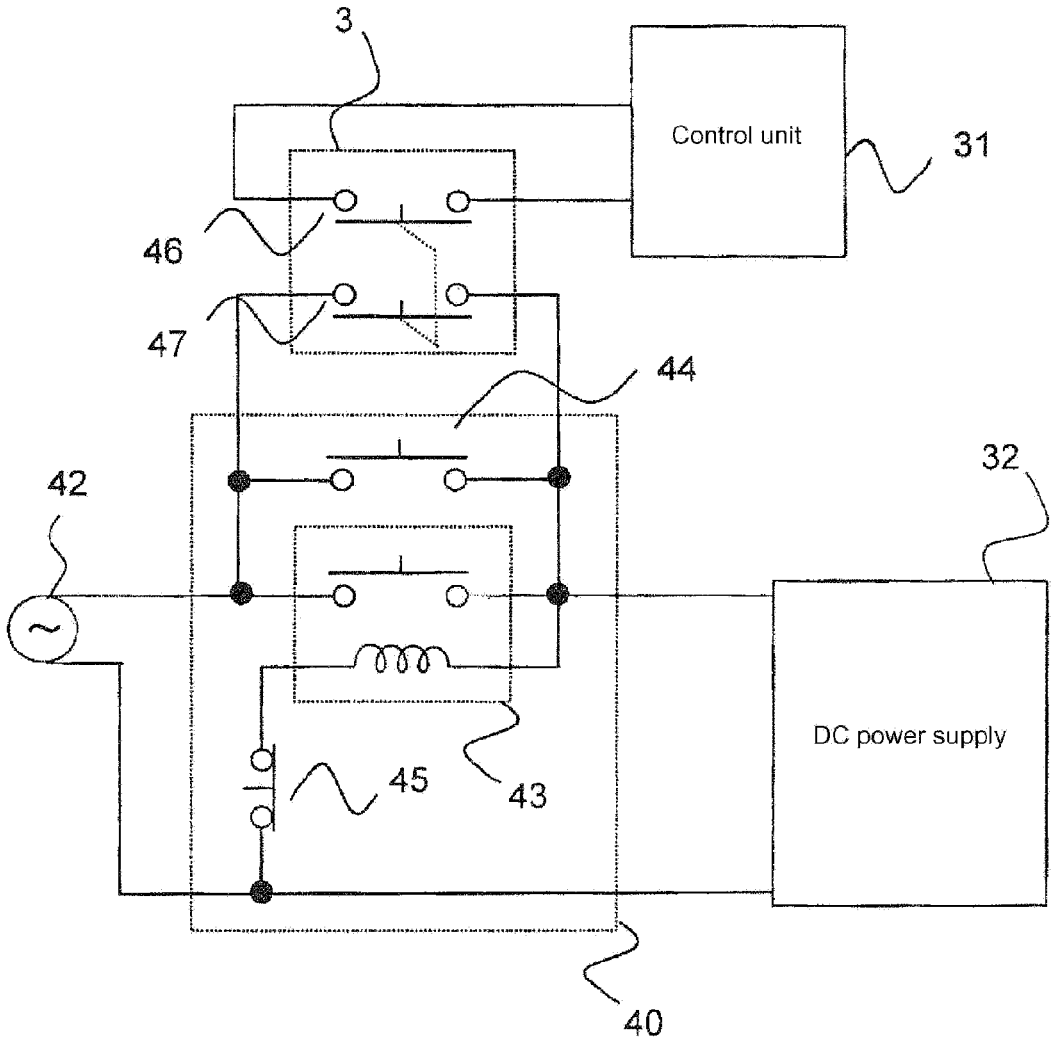
FIG. 5 is a circuit diagram of the second embodiment of the present invention.

FIG. 5 shows a circuit diagram of the power switch 40 and the open/close switch 3. The open/close switch 3 as shown in the drawing includes two polar switches 46, 47, with one pole for the switch 46 connecting to the control unit 31 to detect the opening and closing of the manual feed tray 2 by the control unit 31, and the other pole of switch 47 being connected to both ends of the switch of the relay 43. In the same way, the on switch 44 of the image forming device is also connected to both ends of the switch of the relay 43. The relay 43 is connected between the AC power supply 42 and the DC power supply 32, and both ends of the switch of the relay 43 are connected to one side of the AC power line. One end of the coil of the relay 43 is connected to the DC power supply 32 side of the AC power supply line, and the other end is connected to one end of the off switch 45 of the image forming device. The other end of the off switch 45 is connected to the other side of the AC power supply line.

With this construction, when a user opens the manual feed tray 2 (arrow A in FIG. 1) with the power of the image forming device in the off state, the two switches 46, 47 of the open/close switch 3 are connected, allowing power to be transmitted from the AC power supply 42 to the DC power supply 32 while the coil of the relay 43 transmits electricity that turns on the switch to the relay 43. When power is transmitted from the AC power supply 42 to the DC power supply 32, the control unit 31, through the signal of the open/close switch 3, detects that the manual feed tray 2 has been opened, turns on the power control unit a 33, and thereby transmits drive power to the bypass unit 25. Further, the power control unit b 34 may be turned off at this time, cutting the drive power to the main unit 15.

In other words, when the manual feed tray 2 is opened, it is assumed that the user will certainly use the image forming device, so power conservation can be devised by turning the main power and the bypass switch on only at this time.

Further, when the user closes the manual feed tray 2 (arrow B in FIG. 1), although the switch 47 of the open/close switch 3 removes the connection, electricity can be transmitted through the coil of the relay 43 because the switch of the relay 43 is on, and the on status of the switch 43 will remain as is until the switch 45 is turned off.

In other words, when the manual feed tray 2 is closed, the user will certainly not use the bypass unit 25, so power conservation can be devised by cutting drive power to the bypass unit 25, but because there is a possibility that printing will be done using the main unit 15, the main power is preferably not cut.

According to the above, whether or not a user is to use the image forming device can be reliably detected, thereby enabling energy conservation.

Moreover, any open/close switch can be used as the open/close switch 3 as long as it is a switch that operates the connection and release by detecting the opening and closing of the manual feed tray 2, and this includes even a mechanical switch and optical switch that uses a photo sensor.

The image forming device that relates to the present invention reliably detects whether or not a user is about to use the image forming device, and has the ability to conserve power consumption with an inexpensive and simple design. Accordingly, it can be used as a printer, copying machine, or MFP.

This application claims priority to Japanese Patent Application No. 2005-013269. The entire disclosure of Japanese Patent Application No. 2005-013269 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device, comprising:

a main unit having a first feed roller and being configured to supply paper from a paper supply cassette to a feeding unit;

a bypass unit having a second feed roller and being configured to supply paper from an openable and closable manual feed tray;

an open/close switch being configured to detect the opening and closing of the manual feed tray; and a first power supply control unit being configured to supply a specific power to the bypass unit to operate the second feed roller only when the open/close switch detects that the manual feed tray is open;

a second power supply control unit being configured to supply a specific electrical power to the main unit;

a control unit being configured to receive a signal from the open/close switch and to turn off power to the first power supply control unit and to turn on power to the second supply control unit when the open/close switch detects that the manual feed tray is closed;

a DC power supply being connected to the first and second power supply control units; and a power switch unit being configured to receive a signal from the open/close switch and having two switches to allow power to be transmitted from an AC power supply to the DC power supply.

2. An image forming device, comprising:

a main unit being configured to supply paper from a paper supply cassette to a feeding unit;

a bypass unit being configured to supply paper from an openable and closable manual feed tray;

an open/close switch being configured to detect the opening and closing of the manual feed tray; and a first power supply control unit being configured to supply a specific electrical power when the open/close switch detects the manual feed tray is open, the specific electrical power being a power supply to drive the bypass unit;

a second power supply control unit being configured to supply a specific electrical power to the main unit;

a control unit being configured to receive a signal from the open/close switch and to turn off power to the first power supply control unit and to turn on power to the second supply control unit when the open/close switch detects that the manual feed tray is closed;

a DC power supply being connected to the first and second power supply control units; and a power switch unit being configured to receive a signal from the open/close switch and having two switches to allow power to be transmitted from an AC power supply to the DC power supply.

3. The image forming device according to claim 2, wherein the open/close switch is a push type switch.

4. The image forming device according to claim 2, wherein the main power supply is a DC power supply.

5. An image forming device, comprising:

a main unit being configured to supply paper from a paper supply cassette to a feeding unit;

a bypass unit being configured to supply paper from an openable and closable manual feed tray;

an open/close switch being configured to detect the opening and closing of the manual feed tray; and a first power supply control unit being configured to supply a specific electrical power when the open/close switch detects the manual feed tray is open, the specific electrical power being a main power supply of the image forming device;

a second power supply control unit being configured to supply a specific electrical power to the main unit:

a control unit being configured to receive a signal from the open/close switch and to turn off power to the first power supply control unit and to turn on power to the second supply control unit when the open/close switch detects that the manual feed tray is closed;

a DC power supply being connected to the first and second power supply control units; and a power switch unit being configured to receive a signal from the open/close switch and having two switches to allow power to be transmitted from an AC power supply to the DC power supply.

6. The image forming device according to claim 5, wherein the second power supply control unit cuts off the drive power supply of the main unit when the open/close switch detects that the manual feed tray is open, and the main power supply of the image forming device is configured to function as the drive power supply of the main unit.

7. The image forming device according to claim 6, wherein the second power supply control unit transmits the drive power of the main unit when the open/close switch detects that the manual tray has been closed.

8. The image forming device according to claim 5, wherein the open/close switch is a push type switch.

9. The image forming device according to claim 5, wherein the main power supply is a DC power supply.

10. An image forming device, comprising:

a main unit being configured to supply paper from a paper supply cassette to a feeding unit;

a bypass unit being configured to supply paper from an openable and closable manual feed tray;

an open/close switch being configured to detect the opening and closing of the manual feed tray;

a first power supply control unit being configured to supply a specific electrical power when the open/close switch detects the manual feed tray is open; and a second power supply control unit being configured to supply a specific electrical power to the main unit;

a control unit being configured to receive a signal from the open/close switch and to turn off power to the first power supply control unit and to turn on power to the second supply control unit when the open/close switch detects that the manual feed tray is closed;

a DC power supply being connected to the first and second power supply control units; and a power switch unit being configured to receive a signal from the open/close switch and having two switches to allow power to be transmitted from an AC power supply to the DC power supply.

11. The image forming device according to claim 10, further comprising a main power supply configured to remain on when the open/close switch detects that the manual feed tray is closed.

12. The image forming device according to claim 10, wherein the open/close switch is a push type switch.

13. The image forming device according to claim 10, further comprising a control unit configured to receive a signal from the open/close switch and to turn on power to the first power supply control unit and to turn off power to the second supply control unit when the open/close switch detects that the manual feed tray is open.

14. The image forming device according to claim 13, further comprising a main power supply configured to turn on when the open/close switch detects that the manual feed tray is open.

* * * * *